US005506405A

United States Patent [19]

Yoshida et al.

[11] Patent Number: 5,506,405

[45] Date of Patent: Apr. 9, 1996

[54] EXCITATION ATOMIC BEAM SOURCE

[75] Inventors: Yoshikazu Yoshida, Izumi; Shinichi Mizuguchi, Katano, both of Japan

[73] Assignee: Matsushita Electric Industrial Co., Ltd., Osaka, Japan

[21] Appl. No.: 220,872

[22] Filed: Mar. 31, 1994

[30] Foreign Application Priority Data

Apr. 1, 1993 [JP] Japan ..... 5-075490
Apr. 7, 1993 [JP] Japan ..... 5-080495

[51] Int. Cl.[6] ..... H05H 1/24; H05H 3/00

[52] U.S. Cl. ..... 250/251

[58] Field of Search ..... 250/251

[56] References Cited

U.S. PATENT DOCUMENTS

| | | | |
|---|---|---|---|
| 4,891,095 | 1/1990 | Ishida et al. | 156/643 |
| 4,957,061 | 9/1990 | Ando et al. | 118/719 |
| 5,108,535 | 4/1992 | Ono et al. | 156/345 |
| 5,282,899 | 2/1994 | Balmashnov et al. | 118/723 R |
| 5,286,331 | 2/1994 | Chen et al. | 156/345 |
| 5,336,533 | 8/1994 | Balmashnov | 427/562 |

FOREIGN PATENT DOCUMENTS 1-313897 12/1989 Japan .

OTHER PUBLICATIONS

L. Vàlyi, "Atom and Ion Sources", *A Wiley–Interscience Publication,* 1977, pp. 90–97.

"Reactive Atom Radical Sources for Thin Film Processes", Oxford Applied Research.

*Primary Examiner*—Bruce C. Anderson

*Attorney, Agent, or Firm*—Wenderoth, Lind & Ponack

[57] ABSTRACT

In an excitation atomic beam source for use in doping impurities to a semiconductor, a magnetic field is generated in a space between a nozzle (12) and a skimmer (13). A microwave discharge is generated in the space to form a plasma in the space by applying microwaves to a gas to be ionized emitted from the nozzle (12). In this manner, high-velocity particles and excited atoms in the plasma are passed through the skimmer (13) to thereby generate a supersonic excitation atomic beam.

10 Claims, 4 Drawing Sheets

EXCITATION ATOMIC BEAM SOURCE

BACKGROUND OF THE INVENTION

1. Field of the Invention

The present invention relates to an excitation atomic beam source, in particular to a high-velocity excitation atomic beam source for use in doping impurities into a semiconductor material in a thin film process and the like.

2. Description of the Prior Art

Below described are conventional excitation atomic beam sources with reference to FIGS. 6 and 7.

FIG. 6 shows a conventional excitation atomic beam source, for example, the "Radical Beam Source" made by Oxford Applied Research. The excitation atomic beam source is provided with a plasma generation chamber 61 whose peripheral wall is made of glass. High-frequency coils 62 are wound around the chamber wall. When nitrogen gas is fed into the plasma generation chamber 61 through a gas inlet tube 63, a high-frequency plasma 64 is produced in the chamber 61 upon application of high-frequency waves from the coils 62. Excited nitrogen atomic beams together with electrons, ions, and neutral particles are generated in the plasma 64 and emitted into a process chamber 66 through a hole 67 defined in a beam outlet plate 65 due to a pressure difference.

However, in such an excitation atomic beam source, excited atoms emitted through the hole of the plate 65 are diffused to reach a workpiece in the process chamber 66, and therefore it would be difficult to obtain sufficient nitrogen doses required to produce, for example, a p-type ZnSe semiconductor device or the like device.

FIG. 7 shows another type of a conventional high-velocity atomic beam source as disclosed in the Japanese Patent Unexamined Laid Open Hei 1-313897, where an electric discharge takes place in a gap between a needle-shaped anode 71 and an ion-neutralizing nozzle 73 protruded from a first cathode 72 to thereby generate a glow discharge in the space by a high d.c. voltage application. A magnetic field is applied to the gap between the anode 71 and the nozzle 73 by a magnet 77. A gas is supplied to the nozzle 73 through a gas inlet tube 76 to be dispersed in a space between the anode 71 and the cathode 72 so that ions are contacted with the gas. Ions produced by the glow discharge are converged to have high density and accelerated by an applied electric field toward the nozzle 73 and fed back into the nozzle 73. When the ions are contacted with the gas remaining in the nozzle, each ion loses its electric charge and turns to a neutral atom. In this case, kinetic energy of the ions is taken up by the neutral atoms to form a high-velocity atomic beam in the nozzle 73, which the resultant atomic beam is emitted outside from the nozzle 73.

According to the construction mentioned above, the high-velocity atomic beam emitted through the nozzle 73 is converged to have a high convergent quality approximately equal to the inner diameter of the nozzle.

In this type of the conventional construction, however, the anode and cathode, which function as high d.c. voltage electrodes, are used for generating a glow discharge. Therefore, a mixture of impurities due to use of the anode and cathode can not be avoided, and it is impossible to reduce a processing gas pressure.

Moreover, an atomic beam is excited in the glow discharge space before the nozzle and then the excited beam is derived through the nozzle to the outside. Therefore, it is difficult to obtain high excitation and high-density doses of atomic beams with low power and low gas pressure.

As described above, in the conventional atomic beam source, there has not been suggested or taught any excitation atomic beam source in which a plasma is generated in a space between a nozzle and a skimmer using a microwave for exciting a processing gas.

SUMMARY OF THE INVENTION

Accordingly, in view of the above-described problems, an essential objective of the present invention is to provide an excitation atomic beam source capable of generating a supersonic excitation atomic beam with high purity and high directivity for use in a process of doping impurities to a semiconductor film.

In order to achieve the objective mentioned above, a first inventive excitation atomic beam source comprises a plasma generation means for generating a plasma in a space between a nozzle and a skimmer and means for generating a supersonic atomic beam, whereby high-velocity excited atoms aligned in direction (i.e. a substantially linear, collimated and highly directed supersonic excited gas beam) can be made to reach a workpiece.

With the arrangement of the first feature of the present invention, a supersonic excitation atomic beam can be obtained, which allows nitrogen doping to be sufficiently effected to, for example, ZnSe thin films.

Another objective of the present invention is to provide an excitation atomic beam source which can apply a magnetic field in an axial direction of a reentrant cylindrical cavity resonator to confine electrons and ions, whereby electrically neutral excited atoms can be preferentially drawn out radially.

In order to attain the above objective, a second inventive excitation atomic beam source comprises: a discharge chamber of a reentrant cylindrical cavity resonator which includes a central conductor and an outer conductor, and which has its one end portion terminated by a microwave inlet port and another end portion terminated by a capacitive reactance member; means for applying a magnetic field in an axial direction of the discharge chamber; an excitation-object gas inlet port provided in the outer conductor; and an excited atom outlet port provided in the outer conductor and serving to radially draw out excited atoms.

With the arrangement of the second feature of the invention, by action of microwaves and magnetic fields, high-density plasma is generated in a discharge chamber. Electrons and ions in the plasma are confined by axial magnetic fields. In this state, neutral ground-state atoms and excited atoms, which are not affected by magnetic fields, will be easily discharged from the radial outlet into the process chamber where the workpiece is present.

BRIEF DESCRIPTION OF THE DRAWINGS

These and other ojects and features of the present invention will become apparent from the following description taken in conjunction with the preferred embodiment thereof with reference to the accompanying drawings, in which.

DETAILED DESCRIPTION OF THE PREFERRED EMBODIMENTS

Figure 1:
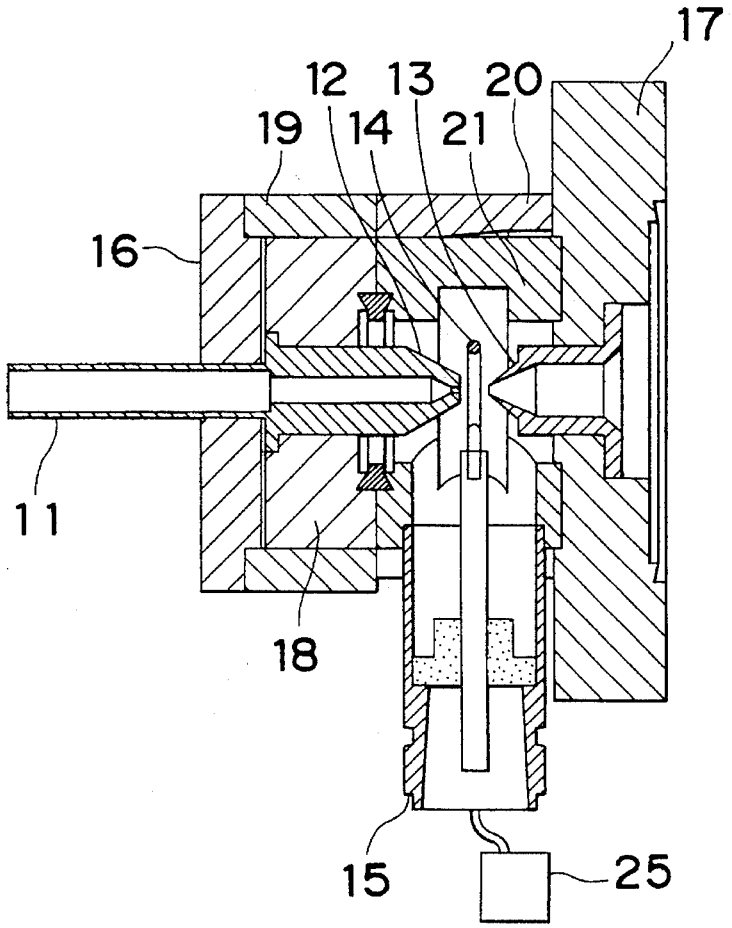
FIG. 1 is a sectional view of an excitation atomic beam source according to a first embodiment of the present invention.
Figure 2:
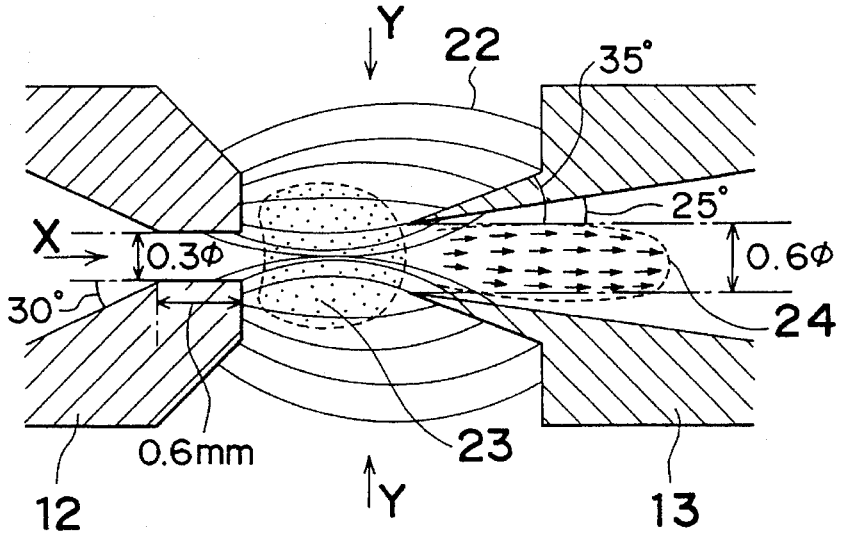
FIG. 2 is an explanatory view for use in explaining operations of the first embodiment shown in FIG. 1.

The following describes a first embodiment of an excitation atomic beam source according to the present invention with reference to FIGS. 1 and 2.

Referring to FIG. 1, in an excitation atomic beam source, a gas stream is introduced through a gas inlet tube 11 and passed through an orifice of a nozzle 12 to be supplied into a plasma generation chamber 21 whose peripheral wall is made of a non-magnetic material such as copper. Then the supplied gas is fed into a hole of a skimmer 13 which allows only a center portion of the gas stream flux to pass therethrough so as to provide a substantially linear stream of excited atoms.

From a general law of aerodynamics, for example, according to the design disclosed in "ATOM AND ION SOURCES" by L. Valyi, John Wiley & Sons Publishing Co., London, 1977, p. 91–94, atoms that have passed through a skimmer become supersonic atoms having sufficient velocity and directivity to form a supersonic atomic beam.

In the construction of the excitation atomic beam source of the first embodiment shown in FIG. 1, microwaves of a specific value, for example, 2.45 GHz are generated by a microwave generator unit 25 and transmitted to a loop antenna 14 via a coaxial connector 15 and the like. The loop antenna 14, which is made of a refractory metal such as tantalum having a high melting point, is disposed in a gap between the nozzle 12 and the skimmer 13 in the plasma generation chamber 21 so that the microwaves are radiated from the loop antenna 14 to the gas stream in a space between the nozzle 12 and the skimmer 13 in the plasma generation chamber 21. The nozzle 12 and the skimmer 13 are each made of a magnetic material, and are respectively connected to an upper flange 16 made of a magnetic material and a lower flange 17 made of a magnetic material. Between the upper flange 16 and the lower flange 17, there is fitted a ring-shaped permanent magnet 19 and a yoke 20 supported by a guide flange 18 of a non-magnetic material, thereby forming a magnetic circuit having the nozzle 12 and the skimmer 13 serving as magnetic poles for generating a magnetic field of a specific value, for example, 1 KG in the space between the nozzle 12 and the skimmer 13 in the plasma generation chamber 21.

Referring to FIG. 2, in the construction of the atomic beam source, an excitation-object gas to be electrically discharged, for example, nitrogen gas to be excited is introduced through the gas inlet tube 11 and passed through the nozzle 12 in the X-direction as shown in FIG. 2. The nitrogen gas is led from the gas inlet tube 11 into an orifice of the nozzle tube having dimensions of 0.3 mm in diameter and 0.6 mm in length with a cone inner surface of 30 degrees. The nitrogen gas is then supplied into the plasma generation chamber 21. The skimmer 13 having an orifice of 0.6 mm in diameter is disposed in a position away from the tip of the nozzle 12 by a specified distance of, for example, 2.6 mm. The skimmer 13 is a conical tube having an inner surface inclination of, for example, 25 degrees and an outer surface inclination of, for example, 35 degrees.

The microwave is radiated by the loop antenna 14 toward the gap from the periphery thereof between the nozzle 12 and the skimmer 13 in the Y-direction as shown in FIG. 2 to thereby produce a microwave plasma 23. The microwave plasma 23 is intensely confined in the space between the nozzle 12 and the skimmer 13, with the magnetic field 22 of a specific value, for example, 1 KG, which is applied by the magnetic circuit composed of the permanent magnet 19 and the like. In the plasma 23 confined by the magnetic field in the space, the nitrogen gas is excited and passed through the skimmer 13 so that a supersonic atomic beam 24 containing excited nitrogen atoms and electrically neutral particles is emitted while electrons are removed along the magnetic force lines of the magnetic field 22 into the metallic wall of the skimmer 13.

With regard to the velocity of the supersonic atomic beam generated through the skimmer, the dependence of Mach number M on the ratio of distance $l_s$ between the nozzle and the skimmer to the diameter d of the nozzle inlet is represented by $M=M\{l_s/d\}$ as disclosed in FIG. 2.6 of "ATOM AND ION SOURCES" by L. Valyi, John Wiley & Sons Publishing Co., London, 1977, p. 94.

It is to be noted here that, in the first embodiment, although the loop antenna is used as a microwave radiating unit, the shape of the antenna is not limited to a loop, and any other shape such as a rod shape or the like may be used.

According to the excitation atomic beam source of the present invention, a supersonic excitation atomic beam can be obtained and doping of nitrogen to a ZnSe thin film can be implemented. In a concrete example, by radiating a supersonic excitation atomic beam to a ZnSe thin film during a process of MBE growth, a p-type ZnSe thin film having carrier density of $5.4\times10^{17}cm^{-3}$ could be produced with lower power and lower gas pressure compared to the conventional excitation atomic beam source.

Moreover, since no anode or cathode functioning as a high d.c. voltage electrode is not used for generating a glow discharge, a mixture of impurities due to use of an anode and cathode can be avoided, and it becomes possible to reduce a power supply and a processing gas pressure.

Moreover, since an atomic beam is excited in the discharge space for generating plasma between the nozzle and the skimmer, it is possible to obtain high excitation and high-density doses of atomic beams with low power and low gas pressure, thereby suppressing impingement of excited atoms against the wall after passing through the skimmer.

Second Embodiment

A second embodiment of the excitation atomic beam source of the present invention is described below with reference to FIGS. 3 and 4.

The second embodiment largely differs from the first embodiment in that neither a nozzle nor a skimmer is provided in the excitation atomic beam source, where a magnetic field is applied in an axial direction of a discharge chamber.

Figure 3:
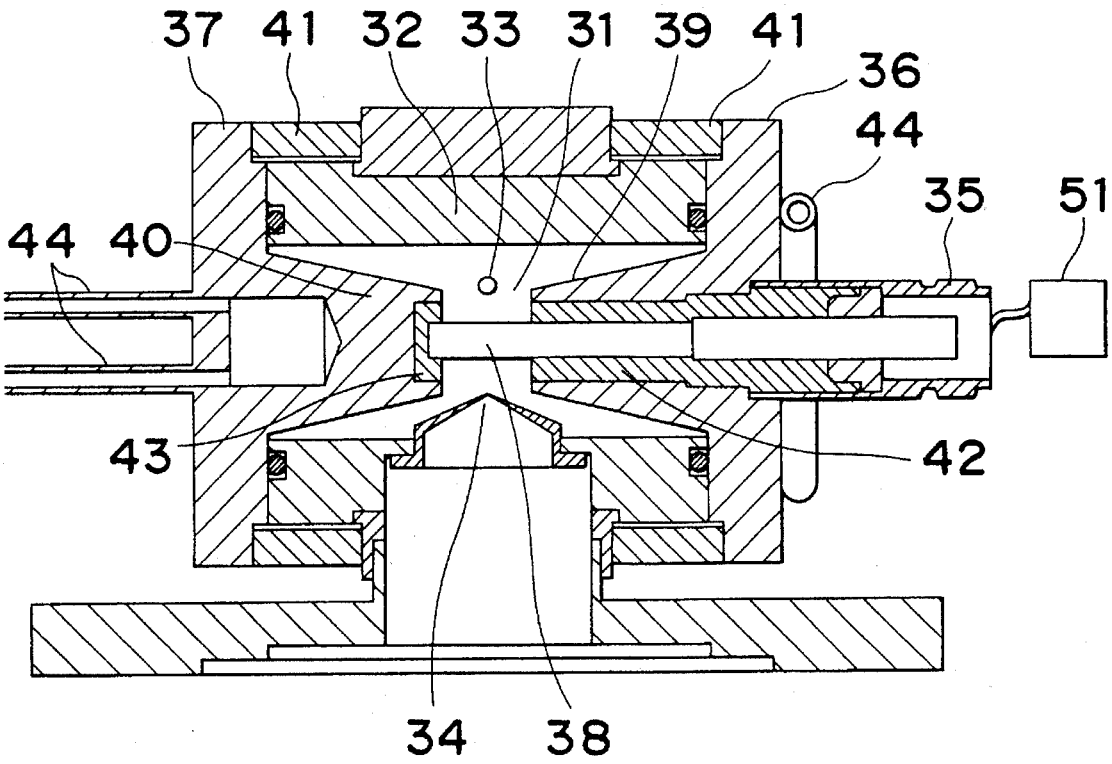
FIG. 3 is a sectional view of an excitation atomic beam source according to a second embodiment of the present invention.

Referring to FIG. 3, reference numeral 31 denotes a discharge chamber serving as a reentrant cylindrical cavity resonator which is surrounded by an outer conductor member 32, where the discharge chamber 31 is provided with a gas inlet port 33 and an excited-atom outlet port 34. The discharge chamber 31 is in a form of a cylinder with an inner diameter of, for example, 26 mm. One end portion of the discharge chamber 31 is closed by a microwave inlet flange 36 having a microwave inlet connector 35 attached thereto, while another end portion thereof is closed by a terminal flange 37 serving as a capacitive reactance. The connector 35 has a central conductor 38 with an outer diameter of, for example, 5 mm, protruding from the connector 35 into the discharge chamber 31.

In the discharge chamber 31 of a reentrant cylindrical cavity resonator, the terminal flange 37 and the central conductor 38 are isolated from each other by a specified distance. The flanges 36 and 37 are provided with cone magnetic poles 39 and 40 protruding inwardly therefrom, respectively, where each pole member projects in a circular truncated cone shape so as to surround the central conductor 38 with a certain space therebetween.

On the outer surface of the outer conductor 32 made of a non-magnetic material, there are fitted axially magnetized ring-shaped permanent magnets 41, which are connected to the magnetic flanges 36 and 37 so that a magnetic field of a specified value, for example, 1.5 KG is applied at the magnetic gap of, for example, 12 mm in distance, between the magnetic poles 39 and 40. To prevent abnormal discharge and to improve thermal conductivity, isolation members 42 and 43 made of an insulating material, for example, boron nitride, are filled in the spaces between the central conductor 38 and the magnetic poles 39 and 40, respectively. The flanges 36 and 37 are further provided with a cooling pipe 44 for circulation of cooling water.

Figure 4:
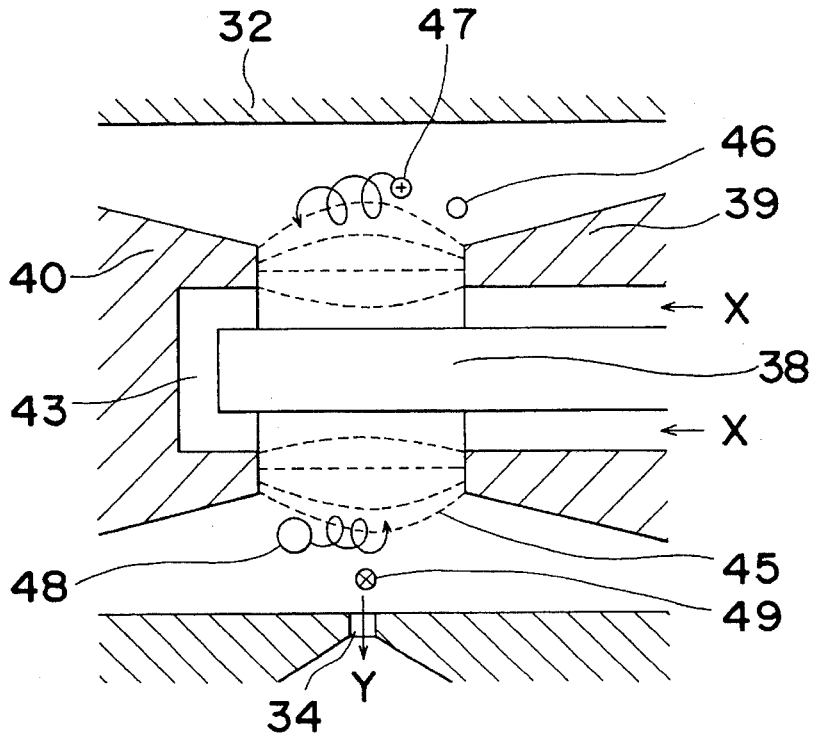
FIG. 4 is an explanatory view for use in explaining operation of the second embodiment shown in FIG. 3.

In this arrangement, as shown in FIG. 4, upon application of the magnetic field 45 in the axial direction of the discharge chamber at the gap between the magnetic poles 39 and 40, plasma of a gas to be excited, for example, of nitrogen gas is generated in the gap by radiating microwaves of, for example, a 2.45 GHz with 100 W from the central conductor 38 to the gas. The microwaves are generated by a microwave generator 51 and transmitted to the central conductor 38 in the X-direction via the microwave inlet connector 35. The plasma of the gas contains neutral particles 46, ions 47, electrons 48, and excitons 49.

It is to be noted here that, in a nonmetallic crystal, an exciton is a quantum of electronic excitation which transports energy but not charge. With a specified value of 1.5 KG in magnetic field, the radius of gyration (Larmor radius) of the nitrogen ions 47 and the electrons 48 becomes less than 1 mm, so that they will not easily diffuse radially. However, the excitons 49 are not affected by the magnetic field, so that they will be discharged in the form of a beam from the excited-atom outlet port 34 by a pressure difference, in the Y-direction. The excited-atom outlet port 34 has a diameter of, for example, 0.2 mm.

Next, a modified example of the second embodiment is described with reference to FIG. 5.

Figure 5:
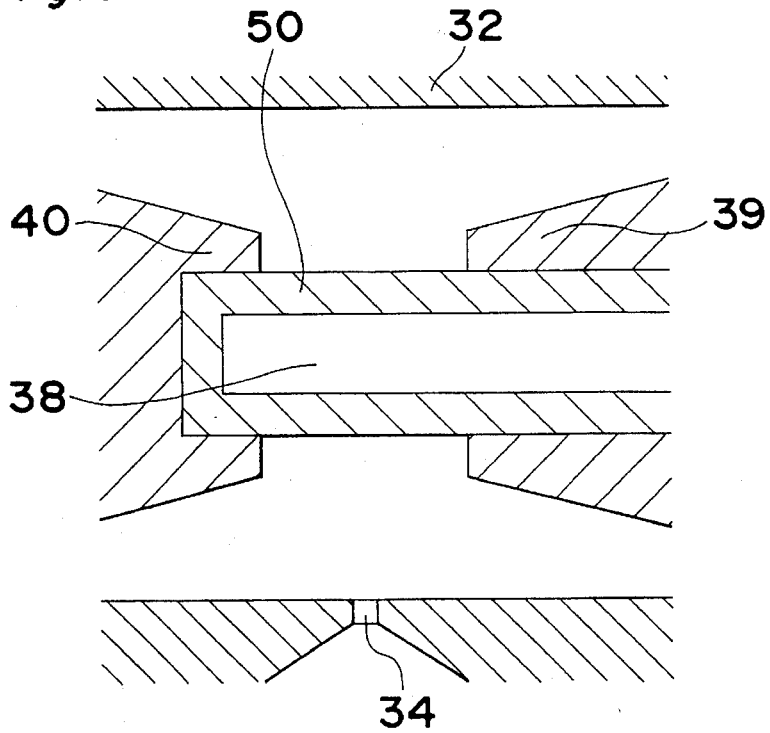
FIG. 5 is a partial sectional view of a modified example of the second embodiment.
Figure 6:
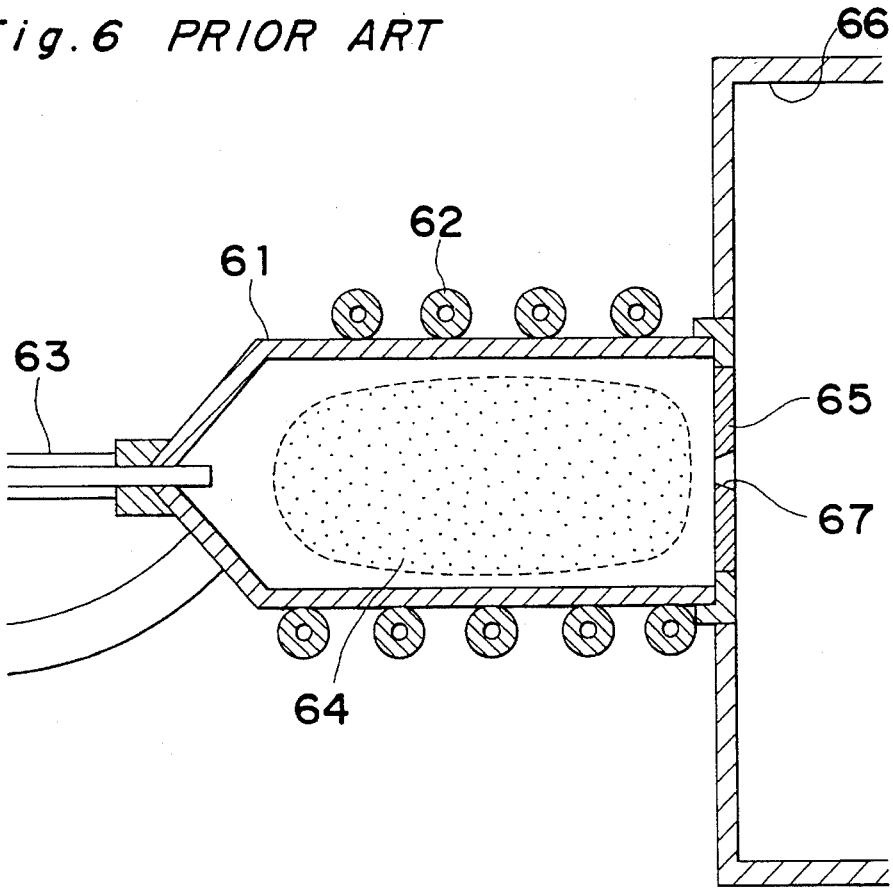
Fig. 6 PRIOR ART
FIG. 6 is a sectional view of a conventional excitation atomic beam source.
Figure 7:
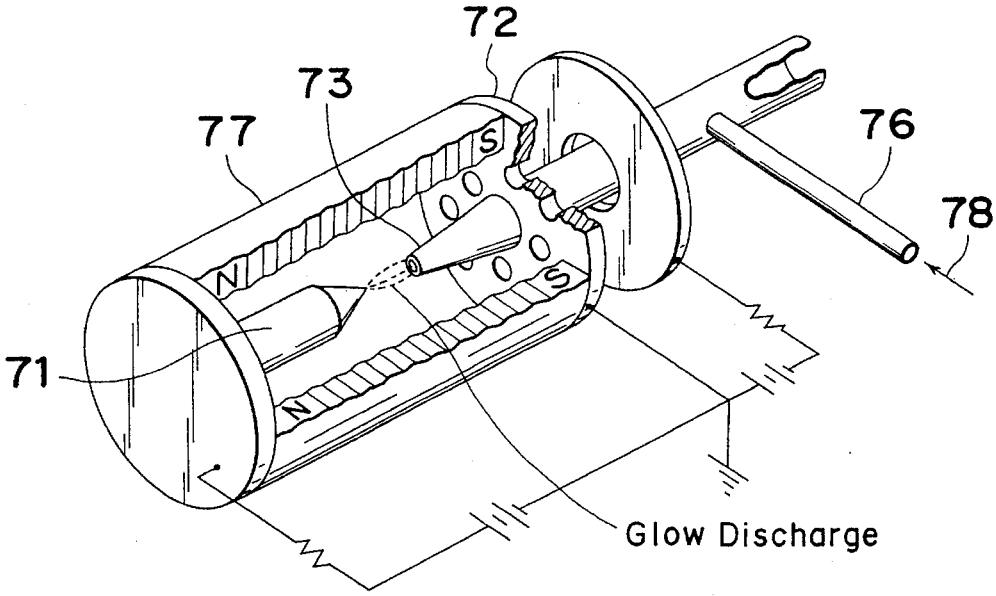
Fig. 7 PRIOR ART
FIG. 7 is a partial sectional view of another conventional excitation atomic beam source.

In FIG. 5, the modified example largely differs from the second embodiment in that the entire central conductor 38 is covered with an isolation member 50 made of an insulating material. The annihilation probability of ions and excitons on the surface of the insulating material is about 1/1000 in comparison to that of the metal surface, and therefore higher generation efficiency of excitons can be obtained.

With the arrangement of the second embodiment according to the invention, by action of the microwaves and magnetic fields, high-density plasma is generated in a discharge chamber. Electrons and ions in the plasma are confined by the magnetic fields applied in the axial direction of a reentrant cylindrical cavity resonator. In this state, neutral ground-state atoms and excited atoms, which are not affected by a magnetic field, are easily discharged from the radial outlet into a process chamber where a workpiece is present. In a concrete example, an excited atom beam could be obtained even with a $5\times10^{-5}$ Pa gas pressure in the process chamber, and doping of nitrogen to ZnSe thin films could be accomplished.

Although the present invention has been fully described by way of example with reference to the accompanying drawings, it is to be noted here that various changes and modifications will be apparent to those skilled in the art. Therefore, unless such changes and modifications otherwise depart from the scope of the present invention as defined by the appended claims, they should be construed as included therein.

What is claimed is:

1. An excitation atomic beam source comprising:

a chamber;

a nozzle for introducing gas into said chamber;

a plasma generation means for generating plasma in said chamber to generate an excited atom gas stream;

plasma confinement means for confining the plasma generated by said plasma generation means in a given space;

a skimmer spaced from said nozzle such that said given space is defined therebetween, said skimmer being operable to receive, as an input from said given space, a portion of the excited atom gas stream and to form, as an output, a substantially linear, collimated and highly directed supersonic excited atom gas beam.

2. The excitation atomic beam source as claimed in claim 1, wherein said plasma confinement means comprises magnetic field generating means for generating a magnetic field in said given space between said nozzle and said skimmer.

3. The excitation atomic beam source as claimed in claim 1, wherein said plasma confinement means comprises a microwave radiating means for radiating microwaves to the gas stream in said given space between said nozzle and said skimmer.

4. The excitation atomic beam source as claimed in claim 3, wherein said microwave radiating means comprises an antenna.

5. The excitation atomic beam source as claimed in claim 1, wherein the gas introduced by the nozzle comprises nitrogen gas.

6. The excitation atomic beam source as claimed in claim 1, wherein the atoms passed through said skimmer have sufficient velocity and directivity to form a supersonic atomic beam.

7. The excitation atomic beam source as claimed in claim 1, wherein said nozzle and said skimmer are formed of a magnetic material; and said plasma confinement means comprises a ring-shaped permanent magnet mounted about said given space.

8. An excitation atomic beam source comprising:

a discharge chamber of a reentrant cylindrical cavity resonator which is composed of a central conductor and an outer conductor into which an excitation gas is supplied, wherein said discharge chamber has its one end terminated by a microwave inlet flange through which said central conductor is inserted for radiating a microwave to the gas in said discharge chamber while another end terminated by a capacitive reactance flange for generating a plasma;

means for applying a magnetic field in an axial direction of said discharge chamber, wherein said outer conductor is provided with an excitation gas inlet port for introducing the excitation gas into said discharge chamber and an excited atom outlet port for radially drawing out excited atoms in the plasma.

9. The excitation atomic beam source as claimed in claim 8, wherein said means for applying a magnetic field further comprises a pair of magnet poles protruding from said flanges respectively so that said pair of magnet poles are opposed to each other around said central conductor.

10. The excitation atomic beam source as claimed in claim 8, wherein said central conductor is covered with an isolation member made of an insulating material.

* * * * *